US006634104B2

(12) United States Patent
Jacobsen

(10) Patent No.: US 6,634,104 B2
(45) Date of Patent: Oct. 21, 2003

(54) INTELLIGENT SHAVER

(75) Inventor: Stephen C. Jacobsen, Salt Lake City, UT (US)

(73) Assignee: Sarcos Investments LC, Salt Lake City, UT (US)

( * ) Notice: Subject to any disclaimer, the term of this patent is extended or adjusted under 35 U.S.C. 154(b) by 52 days.

(21) Appl. No.: 10/039,084

(22) Filed: Jan. 4, 2002

(65) Prior Publication Data

US 2002/0088121 A1 Jul. 11, 2002

Related U.S. Application Data

(62) Division of application No. 09/687,116, filed on Oct. 13, 2000, now Pat. No. 6,497,043.

(51) Int. Cl.[7] ..... B26B 21/40

(52) U.S. Cl. ..... 30/34.05; 132/200; 381/120

(58) Field of Search ..... 30/34.05, 122, 30/123; 132/200; 381/120; 83/76.8, 72, 74, 39

(56) References Cited

U.S. PATENT DOCUMENTS

| | | | | |
|---|---|---|---|---|
| 3,736,243 A | | 5/1973 | Duggan | |
| 5,046,251 A | * | 9/1991 | Scott | 30/140 |
| 5,165,170 A | | 11/1992 | Sagol et al. | |
| 5,182,857 A | | 2/1993 | Simon | |
| 5,533,266 A | | 7/1996 | Kelman | |
| 5,669,921 A | | 9/1997 | Berman et al. | |
| 5,810,858 A | | 9/1998 | Berman et al. | |

* cited by examiner

*Primary Examiner*—Douglas D. Watts
(74) *Attorney, Agent, or Firm*—Thorpe North & Western LLP

(57) ABSTRACT

A shaving device with one or more shaving blades. Sensors are attached to (or near) the blades which produce a shaving signal. A processor or intelligent analysis unit then receives the shaving signal and determines what shaving changes should be made. An audible indicator is coupled to the processor to inform the user of the shaving changes needed. The audible indicator is a speech playback unit, or it produces an audible sound or tone. In the alternative, a visual indicator can be used, such as a liquid crystal (LCD) or a light emitting diode (LED) display, which informs the user of the shaving changes needed.

22 Claims, 3 Drawing Sheets

INTELLIGENT SHAVER

This application is a Divisional Application of application Ser. No. 09/687,116, filed Oct. 13, 2000, titled: INTELLIGENT SHAVER, now U.S. Pat. No. 6,497,043.

TECHNICAL FIELD

This invention relates generally to the field of shavers and razors, and more particularly to an intelligent shaver.

BACKGROUND ART

Ever since the invention of modem razors and shaving devices, research and development regarding shaving has been focused on improving the quality and completeness of the resulting shave. Through this research, there have been many developments in the area of safety razors and other motorized razors. In spite of these developments, the only way which a person can check the actual closeness and smoothness of a shave is to manually feel their skin or use a mirror. The use of this manual method verifies that a person has not overlooked part of the shaving area.

An example of one development which focused on aiding a person in checking the quality of their shave is U.S. Pat. No. 5,165,170 to Sagol. The Sagol patent describes a razor which includes a hair detection means. Included in the razor handle is an audio frequency pickup to detect and amplify the shaving sounds. The person who is shaving then hears these amplified sounds and must interpret the sounds to determine whether the shave is completed or not. The drawback to such a system is that the user must be able to interpret the sounds that are amplified by the device. Although a user interprets the sounds from the Sagol device, the interpretation by the person shaving may or may not be accurate. It can also be irritating to have to listen to the amplified cutting and scraping sounds of shaving.

Accordingly, it would be an improvement over the state of the art to provide a new method and apparatus for aiding a person in determining how to adjust their shaving to produce the best shave. Further, it would be an improvement to provide an apparatus to interpret shaving sounds and movements for the person shaving.

OBJECTS AND SUMMARY OF THE INVENTION

It is an object of the present invention to provide an intelligent shaver for aiding a person in determining how to adjust their shaving to produce the best shave.

It is another object of the present invention to provide an intelligent shaver which interprets and analyzes shaving sounds and provides useful feedback to the person shaving.

It is another object of the present invention to provide an intelligent shaver which interprets a person's shaving movements and provides feedback regarding the orientation and movement of the shaver.

The presently preferred embodiment of the invention is a shaving device which has one or more shaving blades. Attached to or near the blades are sensors which produce a shaving signal. A processor or intelligent analysis unit then receives the shaving signal, and determines what shaving changes should be made. Then an audible indicator coupled to the processor or intelligent analysis unit informs the user of the shaving changes needed. The audible indicator might be a speech playback mechanism, an audible sound or an audible tone. In the alternative, a visual indicator may be used such as a liquid crystal (LCD) display or a light emitting diode (LED) display.

An alternative embodiment of the invention is a shaving device with one or more shaving blades. Attached to the blades (or near the blade) are sensors which produce a shaving signal. An analysis means receives the shaving signal and determines what shaving changes should be made. The data generated by the analysis means is stored in memory until it is downloaded into a computer or some other data gathering device.

A final embodiment of the invention is a method for improving a person's shave, which includes the following steps. The first step is measuring at least one specific shaving parameter to produce a shaving signal. The measuring of these parameters is performed by sensors for measuring the acceleration, sound from a microphone, shaver orientation and other similar parameters through miniaturized sensors. The signals from these miniaturized sensors and microphones are then delivered as a shaving signal to a processor. Next, the shaving signal is processed to determine the shaving changes which should be made by the user to produce a better shave. The final step is producing an indicator based on the information received from the processor to instruct a person regarding improving the person's shaving. The indicator will be either a visual display, a sound or recorded speech which tells the person what adjustments should be made to their shaving method.

These and other objects, features, advantages and alternative aspects of the present invention will become apparent to those skilled in the art from a consideration of the following detailed description taken in combination with the accompanying drawings.

DISCLOSURE OF THE INVENTION

Reference will now be made to the drawings in which the various elements of the present invention will be given numerical designations and in which the invention will be discussed so as to enable one skilled in the art to make and use the invention. It is to be understood that the following description is only exemplary of certain embodiments of the present invention, and should not be viewed as narrowing the claims which follow.

Figure 1:
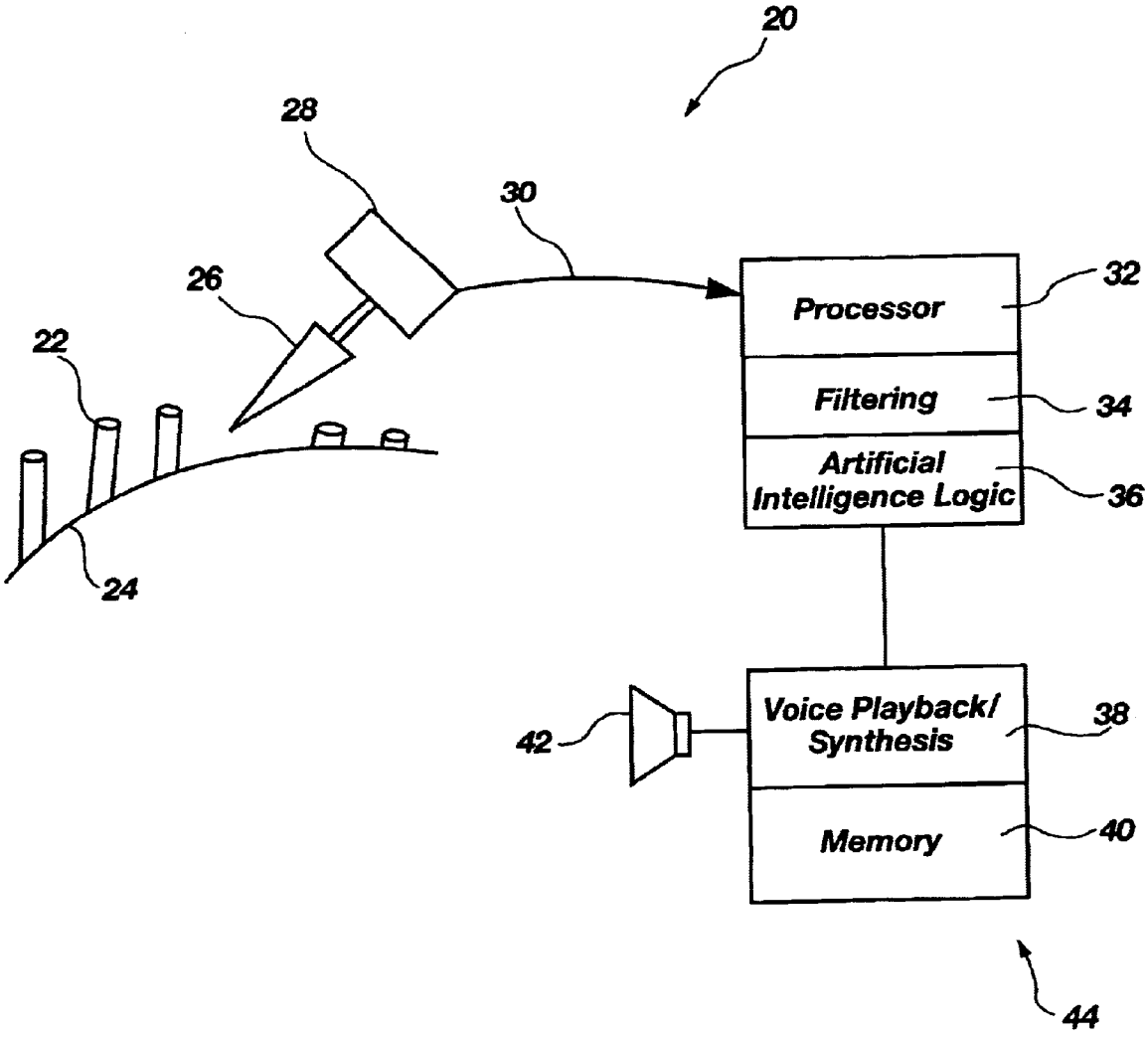
FIG. 1 shows an intelligent shaver coupled to a processor and voice playback/synthesis unit.

Referring now to FIG. 1, an intelligent shaver is shown. The shaving device 20 includes a shaving blade 26 which is coupled to a sensor means 28 or near the sensor means. The figure also illustrates how the shaving blade 26 cuts the hair shafts 22 which extend from the skin 24. The sensor means 28 is preferably a microphone and/or an accelerometer, but other similar sensors could be used. The microphone and/or accelerometer generate an electrical signal 30 which is transferred to a processor 32 or microprocessor. The processor 32 is then able to determine what shaving changes should be implemented based on the signals supplied to it from the sensors. In order for the processor to determine the meaning of the electrical signals, it must first filter 34 the original signal. The filtering removes noise or detected motion which is not directly related to shaving. Filtering also eliminates sounds which are outside the normal bandwidth of sounds generated by shaving. There is a known noise range or bandwidth for shaving sounds and known acceleration and movement ranges for shaving movements. Any noises which are outside the expected range of shaving noise or any movements which are not generated by shaving should be filtered out.

For example, if the user removes the shaver from their face and moves it quickly from one side of the head to the opposite side, this relatively extreme movement should not be taken into to account in the processing. A similar extreme movement which should not be taken into account during analysis is where the razor is dropped. Another example of noise which should be filtered is the noise of a person speaking while they are shaving. Speaking noise or other types of ambient noise (e.g., hair dryers and other bathroom appliances) should be filtered from the signal so that the resulting shaving suggestions will be correct. Other noises and vibrations may also exist as a result of handling the shaving device and these should also be filtered out. If no filtering takes place, the artificial intelligence logic 36 could easily be misled. The filtering may be accomplished with analog high pass filters, analog low pass filters, or by digitizing the information and then using a digital filter.

After the filtering takes place, the filtered signal is processed by the processor 32 using the artificial intelligence logic 36. The artificial intelligence logic draws conclusions from the filtered signal, such as whether the person should be shaving faster or slower to provide a quality shave. Signals from the accelerometer help indicate whether the user is shaving at the correct speed. In addition to the accelerometer, an orientation sensor can be used to determine whether the shaver is upside down or right side up and whether the current shaving device orientation is the appropriate shaving orientation. This type of sensor can also help determine if the shaver is moving in the correct direction relative to hair growth.

The microphone sounds and accelerometer signals 28 can be interpreted to decide whether more shaving cream or lotion is needed during shaving and whether the shaving blade has become dull. This situation will occur when the sounds are louder than normal because no lotion is used or the blade is dull. Most important, the artificial intelligence is used to analyze the incoming shaving sounds to determine when shaving is complete. The artificial intelligence logic will be able to detect that the shaving is completed because the shaving sounds or actual cutting sounds will decrease or stop. Further, the sounds of cutting in the correct direction relative to hair growth versus the different sound of cutting in the wrong direction relative to hair growth can be analyzed.

Once the processor 32 and the artificial intelligence logic 36 have determined what action should be taken by the person shaving, this information must be communicated to the person. FIG. 1 shows that the information is communicated to the person through an audible indicator 44 which is coupled to the processor 32. In the preferred implementation of the invention, certain selected phrases are electronically sampled or recorded and stored in memory 40. These will be phrases spoken by a human such as "Shaving faster is recommended." Other phrases will also be recorded to instruct the person shaving to shave slower, change direction, apply lotion, use a new blade or that the shaving is completed. These pre-recorded phrases will be played by the voice playback unit 38 through the attached speaker 42. These messages help the person shaving to improve their shaving or select changes they believe will improve their shaving the most.

The messages from the shaver can also be played back via a voice synthesizer. This method uses less overall memory 40, but a computer generated voice sounds very monotone or mechanical. An advantage of using an audible indicator is that the user of the shaver does not have to stop shaving to hear the advice given by the shaver. Furthermore, the person does not have to listen to an amplified shaving noise, as in the prior art, they only receive a simple message after the data contained in the shaving signal has been analyzed.

Figure 2:
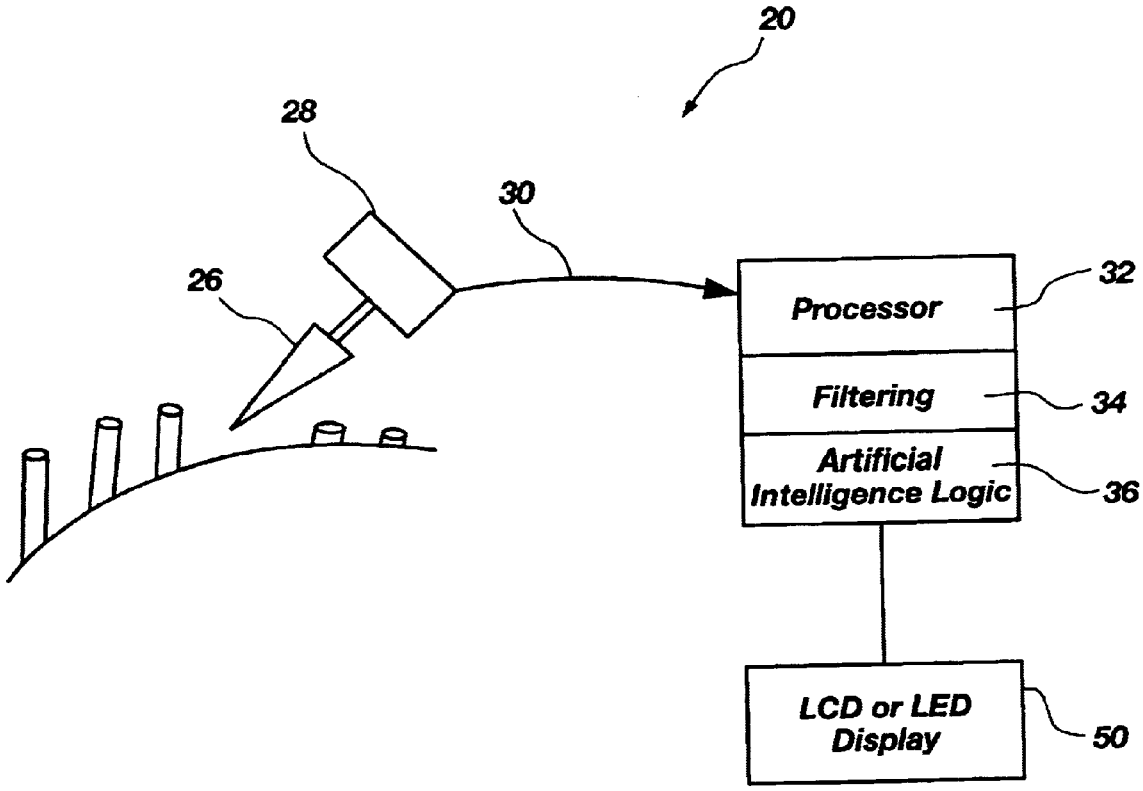
FIG. 2 shows an intelligent shaver connected to a processor and a display device.

FIG. 2 is an alternative embodiment of the invention which shows an intelligent shaver connected to a processor and a visible indication device. The processor 32 and its accompanying filters 34, and artificial intelligence logic 36 are coupled to a visual indication device or display 50. The display 50 can be a liquid crystal display (LCD) or a light emitting diode display (LED). Other similar displays may also be used as they become cost effective (e.g., plasma displays, etc.). In the embodiment using an LCD screen, the processor 32 processes the incoming shaving signal 30. Then the processor uses the artificial intelligence logic 36 to determine what messages should be sent to the LCD. The processor displays the same messages as would have been delivered via the voice playback unit. For example, the message "Shave Faster", "More Lotion", or similar messages are displayed on the LCD display 50. A LCD or LED screen used with the current invention would be relatively small and sized to fit on a manual or electric razor.

The LED embodiment displays the same type of message in a different format. Messages can be displayed as characters on a LED display or in a scrolling manner across the LED screen. In the alternative, the messages could be printed or embossed on the body of the shaver (not shown) with small separate rectangular LEDs which light up and correspond to each message. Using LEDs is desirable because they are a cost-effective display method.

Figure 3:
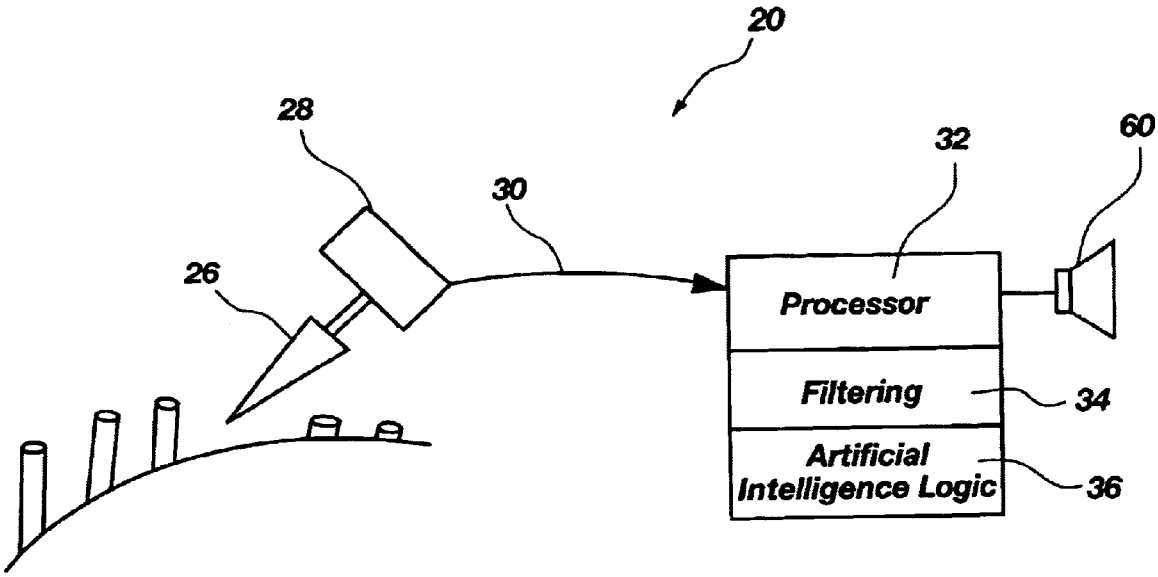
FIG. 3 shows an intelligent shaver attached to a processor and a speaker output.

FIG. 3 shows an intelligent shaver attached to a processor 32 and a speaker output 60. In this embodiment of the invention, the processor 60 is coupled directly to the speaker 50 to produce sounds which correspond with certain predefined messages. For example, a chirping sound could be produced by the processor 32 through the speaker 60 to notify the user that they are shaving too fast or too slow. Another sound such as a chime or a similar sound would be used to inform the person that the shaving is complete. It should be realized that any number of messages could be delivered by producing a selected sound through the speaker 60.

A very useful, yet simplified embodiment of the invention is also shown in FIG. 3. This is a shaving device which produces a pleasing tone when the person shaving is using an effective shaving method. On the other hand, when the person is using ineffective shaving techniques then a second tone is generated which may be less pleasing. For example, if the user is shaving correctly, a gentle chiming noise may be generated. In the case where the user is not using effective shaving techniques, as analyzed by the processor, then a more irritating buzzing sound can be used. It should be clear that the specific noise which is generated is not important, but the fact that different noises are generated for the user when they are shaving effectively and when they are not shaving effectively. These two or more different sounds are generated as selected by the processor 32 and the artificial intelligence logic 36. The artificial intelligence logic 36 selects a more pleasing tone when the sensors detect favorable shaving sounds and motions which are within the predetermined parameters. The less pleasing or different sound will be produced when the sensor information is outside the predetermined parameters. In the invention's simplest embodiment, the processor and artificial intelligence logic could also be replaced by an intelligent filter (e.g., high pass, low pass, or bandpass) which selects an output based on which part of the shaving signal is passed or not passed.

Yet a further embodiment of the invention includes using a processor, filter and artificial intelligence logic to analyze the performance of the razor blade(s). This embodiment is valuable to test specific blades or razor configurations during research and development. The information gathered by the processor is stored in memory and then can be used for research purposes. After the data is collected in memory, it can be downloaded into a separate computer through a computer data connection port which is attached to the razor. This data can be further analyzed to profile the performance of the specific razor.

A device other than a speaker can be used to deliver the audible messages to a person shaving. For example, an earphone can be connected into an earphone jack on the shaving device. This allows the voice playback or voice synthesis to be delivered directly to the user's ear. If tones or sounds are generated, they can also be played through an earphone. More than one earphone can also be used such as stereo earphones but this is more cumbersome. The advantage of using an earphone is that other outside ambient noises do not interfere with messages or sounds intended for the person shaving.

In addition to the embodiments described, a method can be used to improve a person's shave. The first step in the method is measuring at least one specific shaving parameter to produce a shaving signal. The measuring of these parameters includes miniaturized sensors for measuring the acceleration, sound from a microphone, shaver orientation and other similar parameters. The signals from these miniaturized sensors and microphones are then delivered as a shaving signal to a processor. Next, the shaving signal is processed or analyzed to determine the shaving changes which should be made by the user to produce a better shave. Another step is producing an indicator based on the information received from the processor to instruct a person regarding improving the person's shaving. The indicator delivered to the person is either visual or audible.

The paragraph above describes the basic method which would be used to improve a person's shave. In addition, there are other steps which can be included in the device to improve shaving. One additional step is filtering the shaving signal to eliminate noise or motions which are not directly related to shaving. Filtering is done to eliminate sounds which are outside the normal bandwidth of sounds generated by shaving.

Another important step which should be mentioned is applying preprogrammed logic to determine if the person is shaving efficiently and thoroughly. This step is included as a portion of the processing step. The preprogrammed logic then selects instructions which should be transmitted to the person shaving. Accordingly, an additional step in the invention is producing an audible indicator for reproducing voice instructions through a speaker. These voice instructions include messages such as: shave faster/slower, more shaving cream needed, or shaving completed.

An additional embodiment includes the step of using a light emitting diode (LED) indicator to communicate shaving instructions to the user. Another way the shaving device can visually communicate with the user is to use an LCD screen which displays the messages for the user.

The embodiments of the invention described above are able to be used with standard safety razors, electric rotary razors, or in-line electric razors. The electronics for this invention can be miniaturized and mounted into the handle of the razors.

It is to be understood that the above-described arrangements are only illustrative of the application of certain embodiments of the present invention. Numerous modifications and alternative arrangements may be devised by those skilled in the art without departing from the spirit and scope of the present invention. The appended claims are intended to cover such modifications and arrangements.

What is claimed is:

1. A shaving device, comprising:

(a) at least one shaving blade;

(b) at least one sensor means coupled to the at least one shaving blade to produce a shaving signal;

(c) a processor for receiving the shaving signal, wherein the processor determines what shaving changes should be implemented; and (d) audible indication means coupled to the processor to inform the user of the shaving changes needed.

2. The shaving device of claim 1 wherein the sensor means is a microphone to convert shaving, sounds into a shaving signal.

3. The shaving device of claim 1 wherein the sensor means is a n accelerometer to convert shaving motions into a shaving signal.

4. The shaving device of claim 1 wherein the sensor means is an accelerometer and a microphone.

5. The shaving device of claim 1 wherein the processor means further comprises a filtering circuit.

6. The shaving device of claim 1 wherein the processor further comprises artificial intelligence logic to determine the meaning of the shaving signal.

7. The shaving device of claim 1 wherein the audible indication means further comprises a speaker coupled to the processing means to reproduce audible indicators.

8. The shaving device of claim 1 wherein the audible indication means further comprises a voice reproduction circuit and speaker to provide shaving instructions to a person.

9. The shaving, device of claim 1 wherein the audible indication means further comprises a voice synthesizer circuit and speaker to provide shaving instructions to a person.

10. A shaving device comprising, (a) at least one shaving blade;

(b) at least one sensor means coupled to the at least one shaving blade to produce a shaving signal;

(c) a processor for receiving the shaving signal, wherein the processor determines shaving changes which should be implemented; and (d) visible indication means coupled to the processor to inform the user of the shaving changes needed.

11. The shaving device of claim 10 wherein the visible indication means further comprises a plurality light emitting diodes (LEDs) to indicate required shaving modifications.

12. The shaving device of claim 10 wherein the visible indication means further comprises a liquid crystal display (LCD) to indicate required shaving modifications.

13. A shaving device, comprising:

(a) at least one shaving blade;

(b) at least one sensor means coupled to the at least one shaving blade to produce a shaving signal; and (c) analysis means for analyzing the shaving signal.

14. The shaving device as in claim 13 wherein the analysis means determines what shaving changes should be implemented.

15. The shaving device as in claim 13 further comprising an audio indication means coupled to the analysis means which produces a first sound when an effective shaving method is being used and a second sound when an ineffective method of shaving is being used.

16. The shaving device as in claim 14 wherein the analysis means is a processor having artificial intelligence logic.

17. The shaving device as in claim 13 further comprising a data connection port coupled to a computer to download analysis information.

18. A shaving device, comprising:

(a) at least one shaving blade;

(b) at least one sensor means coupled to the at least one shaving blade to produce a shaving signal; and (c) bandpass means for passing a selected part of the shaving signal, wherein the bandpass means determines what shaving changes should be implemented based on the shaving signal.

19. The shaving device as in claim 18 further comprising a data port connection to download analysis information into a computer.

20. The shaving device as in claim 18 wherein the bandpass means is a bandpass filter.

21. The shaving device as in claim 18 further comprising an audio indication means coupled to the bandpass means which produces a first sound when an effective shaving, method is used and a second sound when an ineffective method of shaving is used.

22. The shaving device as in claim 18 further comprising an audio indication means coupled to the bandpass means to inform the user of suggested shaving changes.

* * * * *

UNITED STATES PATENT AND TRADEMARK OFFICE

CERTIFICATE OF CORRECTION

PATENT NO. : 6,634,104 B2
DATED : October 21, 2003
INVENTOR(S) : Stephen C. Jacobsen It is certified that error appears in the above-identified patent and that said Letters Patent is hereby corrected as shown below:

Column 2,
Line 37, add -- and -- after “device;”.

Column 3,
Line 9, delete “to”.

Column 4,
Line 23, replace “A” with -- An --.
Line 28, replace “a” with -- an -- (first appearance)
Line 36, replace “60:” with -- 32 --.
Line 37, replace “50” with -- 60 --.

Column 6,
Line 22, delete “,” after “shaving”.
Line 25, replace “a n” with -- an --.

Signed and Sealed this

Thirteenth Day of April, 2004

JON W. DUDAS
*Acting Director of the United States Patent and Trademark Office*